United States Patent [19]

Hollenton

[11] 3,930,508

[45] Jan. 6, 1976

[54] WRAPPER ABSENCE DETECTING AND CONTROL DEVICE FOR CIGAR MACHINES

[75] Inventor: Frank Hollenton, Richmond, Va.

[73] Assignee: AMF Incorporated, White Plains, N.Y.

[22] Filed: Apr. 24, 1974

[21] Appl. No.: 463,922

[52] U.S. Cl. ..... 131/21 R; 131/105

[51] Int. Cl.[2] ..... A24C 1/28

[58] Field of Search ..... 131/21 R, 21 C, 36, 105

[56] References Cited

UNITED STATES PATENTS

| | | | |
|---|---|---|---|
| 631,330 | 8/1899 | Russell | 131/36 |
| 2,012,149 | 8/1935 | Wheeler | 131/21 R |
| 2,320,346 | 6/1943 | Broekhuysen | 131/21 R |
| 2,324,486 | 7/1943 | Clausen | 131/21 R |
| 2,953,135 | 9/1960 | Anderson | 131/21 R |
| 3,139,091 | 6/1964 | Godfrey et al. | 131/36 X |

FOREIGN PATENTS OR APPLICATIONS

| | | | |
|---|---|---|---|
| 995,787 | 6/1965 | United Kingdom | 131/21 R |

*Primary Examiner*—Joseph S. Reich

*Attorney, Agent, or Firm*—George W. Price; Charles J. Worth

[57] ABSTRACT

A pneumatic-electric, or a pneumatic sensing and control system is used in a cigar making machine to prevent a wrapper or binder paster from operating and a formed tobacco member from being delivered to the roller nest when a tobacco strip is not transferred to the carrier while permitting the machine to continue to run without interruption.

6 Claims, 3 Drawing Figures

WRAPPER ABSENCE DETECTING AND CONTROL DEVICE FOR CIGAR MACHINES

Figure 1:
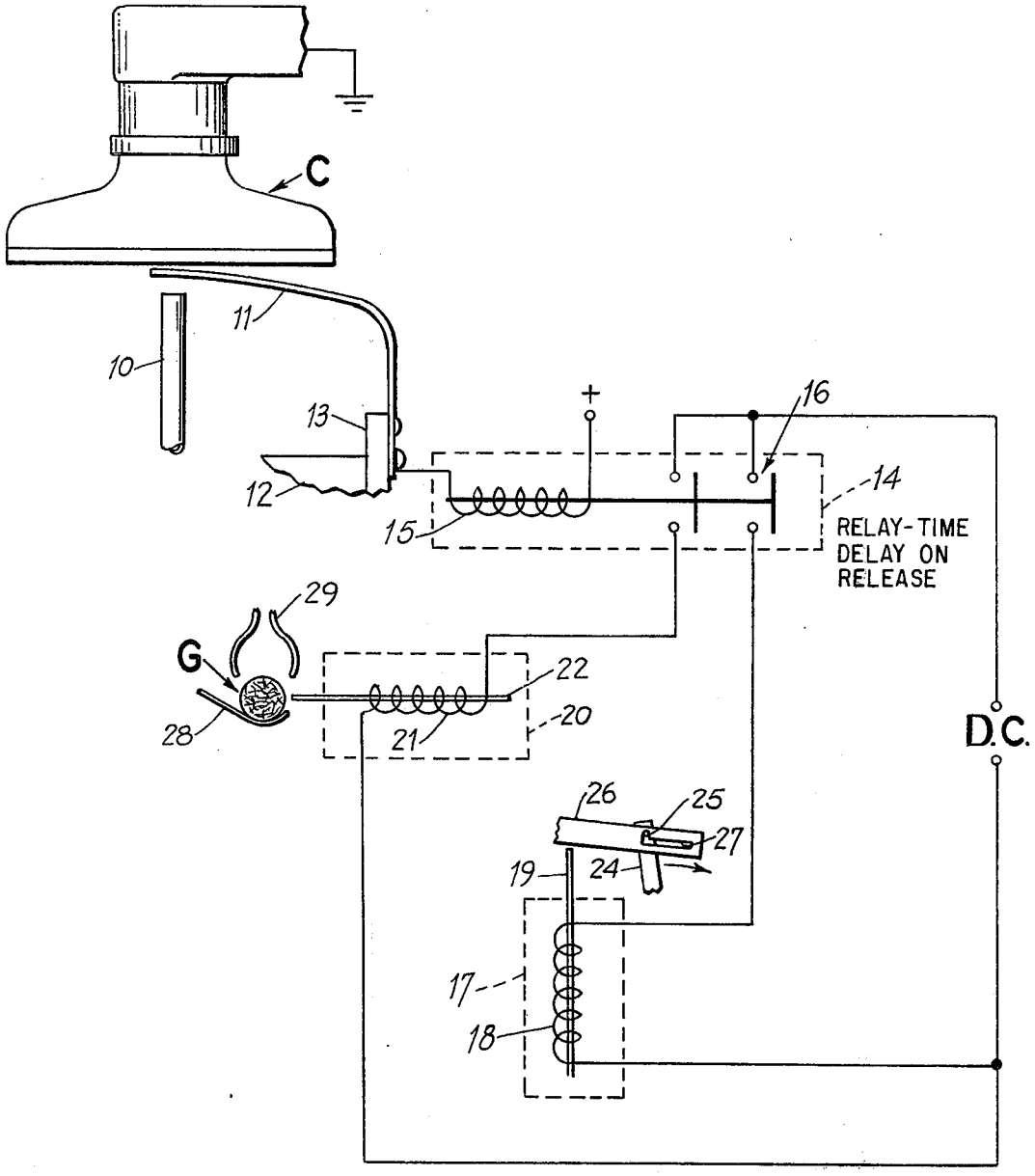

This invention relates generally to cigar machines and more particularly to machinery for applying binders and wrappers when manufacturing cigars.

One of the problems in making cigars is securely fixing a tobacco binder to a rolled tobacco filler to form a cigar bunch from which the binder will not unravel and, thereafter, securely fixing a tobacco wrapper to the cigar bunch from which the wrapper will not unravel. This problem apparently is becoming progressively more pronounced with more and more use of reconstituted tobacco sheet in place of natural leaf for binders and wrappers.

As is well known in the cigar industry, although machinery of individual types are employed for the two operations, tobacco binders are applied to fillers and tobacco wrappers are applied to bunches in a spiral rolling operation. A long relatively narrow tobacco strip or leaf is coiled spirally around the compacted filler cylinder to form the bunch. Later another tobacco strip or leaf is coiled spirally around the bunch to form the cigar. The rolling starts at one end and progress at a uniform spiral pitch toward the other end until the filler or the bunch is completely enveloped in the tobacco binder or wrapper.

As rolling proceeds in each operation, the rear edge of each convolution of the spiral tobacco coil is superposed over the front edge of the last succeeding convolution, with the objective of preventing unwinding. With such an arrangement it is theoretically possible to hold all of the binder in position tightly coiled around the filler in a bunch, and all of the wrapper tightly coiled around the bunch, by applying paste to a small area of the end of the final convolution of the binder and wrapper respectively. However, as is generally well known, in subsequently smoking or otherwise handling of cigars, the head ends of the binder and wrapper at times become loosened and tend to unravel. It is true that percentagewise this occurrence is infrequent. However, the happening, however infrequent, tends to affect the attitude of the smoker toward the product, which is an important consideration in merchandising any product, including cigars, particularly when sold under a brand name.

In order to reduce the incidence of unraveling, new methods of pasting binders and wrappers have been recently introduced in the industry to a limited extent, particularly in the machine manufacture of cigars. One of these methods involves the application of paste to an entire surface area on the single enveloping tobacco element of a machine made Toscani cigar. In machine manufacture of such a cigar, paste is applied over the whole area of the inner surface of the tobacco strip or leaf which forms the cigar envelope. As such a cigar is rolled, not only are the adjacent superposed edges of the spiral convolution pasted together but the envelope is pasted directly to the underlying filler.

In another arrangement, paste is applied by a mechanism along one entire edge and to the head end of a tobacco strip or leaf which has been shaped to form a binder or a wrapper of a cigar. As the binder or wrapper is thereafter rolled into a cigar bunch or into the cigar the superposed adjacent edges of the coiled convolution of the binder or wrapper are pasted one to another.

Regardless of which arrangement is actually used, paste is applied after the binder or wrapper has been trimmed to shape and transferred to the carrier where it is held on the carrier plate by suction and transported to the rolling station to be spirally wound on the filler or bunch. If in the course of normal events a binder or wrapper is not transferred to the carrier, paste would be applied to the rolling surface or carrier plate which would tend to clog the machinery and an unwrapped tobacco filler or cigar bunch, would result.

From the foregoing it should be apparent that the present invention is applicable to machinery for applying binders or wrappers either of natural leaf or reconstituted tobacco to formed fillers or cigar bunches. To obviate the necessity of duplicate description, hereinafter binders and wrappers will be called tobacco strips, and tobacco fillers and cigar bunches will be called formed tobacco members.

Accordingly, an object of the present invention is to provide means to permit a cigar machine to operate without interruption or deleterious effects when a tobacco strip to be wound on a tobacco form is not transferred to the carrier therefor.

Another object of the present invention is to provide the foregoing means which is responsive to fluid pressure for detecting the absence of a tobacco strip from the carrier therefor.

And another object of the present invention is to provide the foregoing means which uncouples the paster from its operating linkage and blocks delivery of a tobacco form to the wrapping station in response to detection of the absence of a tobacco strip from the carrier while permitting the machine to continue to operate without interruption.

The foregoing and other objects and advantages of the invention will appear more fully hereinafter from a consideration of the detailed description which follows, taken together with the accompanying drawings wherein several embodiments of the invention are illustrated by way of example. It is to be expressly understood, however, that the drawings are for illustration purposes only and are not to be construed as defining the limits of the invention.

FIG. 1 diagrammatically illustrates a pneumatic-electrical tobacco strip absence detector and control responsive to positive fluid pressure in accordance with the present invention.

Figure 2:
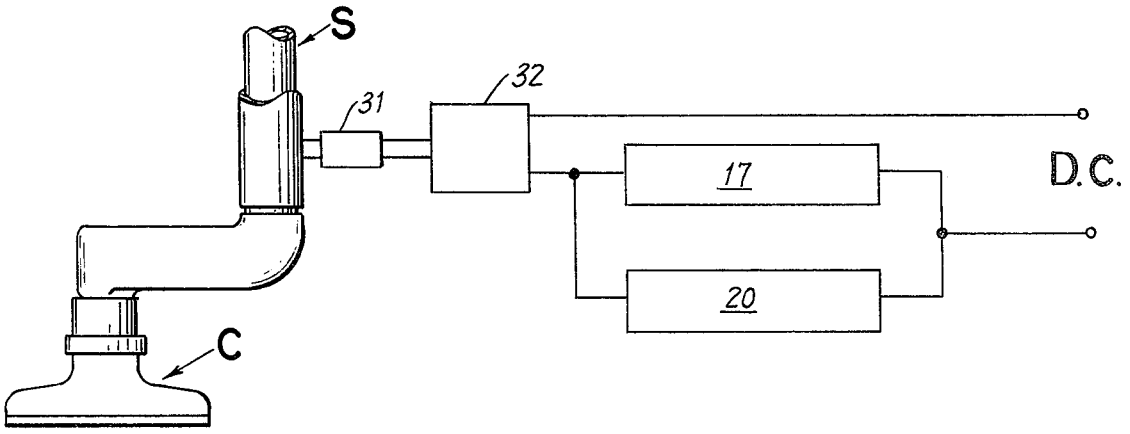

FIG. 2 diagrammatically illustrates the detector and control of FIG. 1 which is modified to respond to suction.

Figure 3:
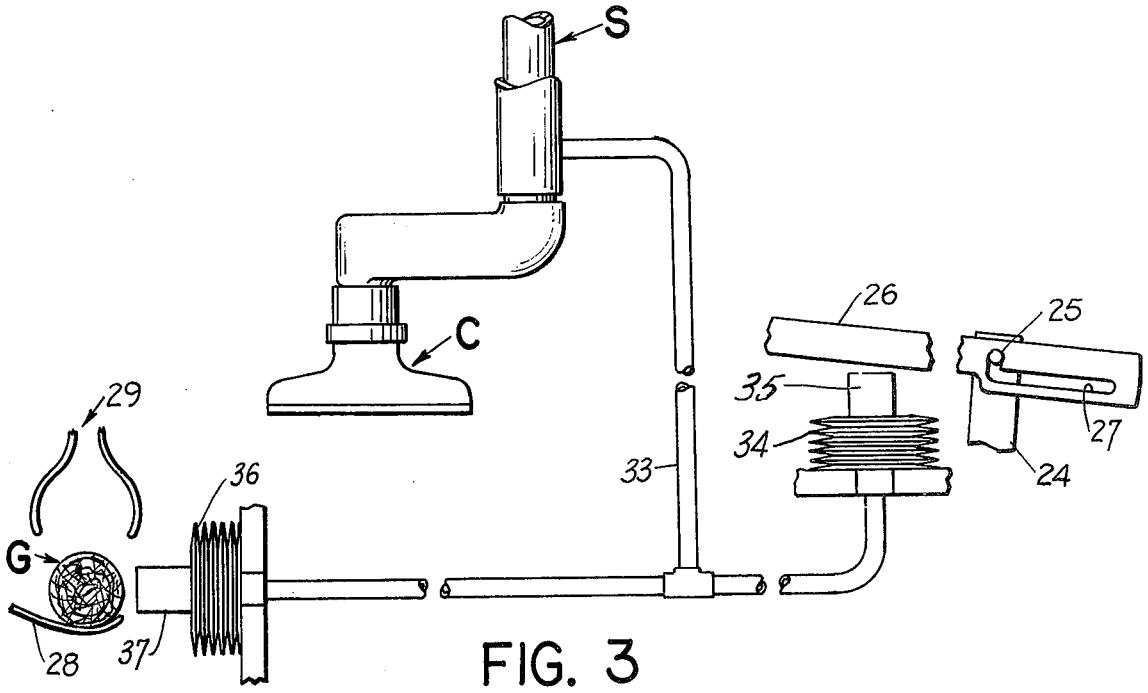

FIG. 3 diagrammatically illustrates a vacuum type of detector and control in accordance with the present invention.

One type of a typical machine which would be enhanced by an absence detector and control made in accordance with the present invention is disclosed in U.S. Pat. No. 3,139,091 granted June 30, 1964 to Godfrey et al and assigned to the same assignee as the present application. As shown in this patent a tobacco strip, in this instance a wrapper W, is fed to a die D of a turret T where it is trimmed to a desired size and shape. The trimmed wrapper W is transferred to a carrier C where it is held by suction and rotated into alignment with a pastor P. Rotation of the carrier C is momentarily interrupted to permit a plate 20 of the paster P to apply paste to the wrapper W. The carrier C then continues to rotate to bring the wrapper W into position at a wrapping station or roller nest R. Simultaneously, jaws 232 and 233 deliver a formed tobacco member, in this instance a cigar bunch G, to the roller nest R. The wrapper W is stripped form the carrier G and spirally wound on the cigar bunch G being rolled by the roller nest R. Upon completion the carrier C rotates back to its original position to receive another trimmed wrapper W and simultaneously the wrapped bunch G is removed from the roller nest R.

Referring now to FIG. 1 of the drawings, the carrier C is electrically connected to ground by a conventionally grounded machine frame and to a source of suction for holding a tobacco strip on the usual carrier plate in the face of the carrier. A jet tube 10 is provided just in advance of the paster (not shown) for providing a timed blast of pressure fluid toward the face of carrier C as the carrier plate approaches the paster. An electrically conductive probe 11 made of conventional switch type contact spring material is fixed or mounted at one end by dielectric material 13 to the machine frame 12 and is free at its other end which is spaced between the face of the carrier C in alignment with the path of the carrier plate, and the discharge end of the jet 10. The fixed or mounted end of the probe 11 is connected to a source of positive current through the coil 15 of a delay on release type of relay 14 such as a CDD38 relay made by the Potter and Brumfield Division of AMF Incorporated. The coils 18 and 21 of a pair of solenoids 17 and 20, respectively, are connected in parallel in a D.C. circuit normally kept open by the normally open switch portion 16 of the relay 14.

In normal operating sequence, as the carrier plate of carrier C approaches the pastor, the jet 10 would emit a timed blast of pressure fluid against the free end of probe 11 causing the free end to move to contact the face of the carrier C. If a tobacco strip was properly transferred to and is being held by the carrier plate, the tobacco strip acts as insulation and the sensing circuit from the positive current source through the relay coil 15, probe 11 and carrier C to ground remains open and the relay 14 is not energized. The sensing circuit having sensed the presence of a tobacco strip, the pastor will apply paste to the strip and a formed tobacco member will appropriately be delivered to the roller nest (not shown) to be wrapped in the tobacco strip.

If, on the other hand, a tobacco strip had not been transferred to the carrier C, its absence would be sensed by the free end of the probe 11 contacting the carrier plate in the face of the carrier C which closes or completes the sensing circuit and causes current to flow in coil 15 thus energizing or actuating the relay 14 which closes its switch portion 16 completing the control circuit including the solenoids 17 and 20.

Any suitable disabling means to prevent pasting and transferring a formed tobacco member to the roller nest which does not require machine stoppage may be used. A typical example is diagrammatically shown by providing the paster operating linkage with a laterally movable or reciprocal member 24 connected by a pin or a similar connector 25 to a longitudinally movable link 26. The member 24 is moved by the usual cam timing means (not shown) of the machine for driving the link 26 which appropriately moves the paster bar or plate to the tobacco strip for applying paste thereto and then returns the bar or plate to its original position. The link 26 is provided with an elongated longitudinal slot 27 with a lateral offset or detent at one end in which the pin 25 is normally disposed. Thus, lateral movement of the member 24 normally will longitudinally move the link 26 and operate the paster. With the control circuit closed by the switch portion 16 of the relay 14, current flows through the coil 18 of the solenoid 17 driving the plunger 19 thereof toward the link 26 causing the end of the link to move laterally. Lateral movement of the link 26 moves the elongated slot 27 into alignment with the pin 25. At this time, normal sequenced lateral movement of the member 24 will cause the pin 25 to travel along the slot 27 and the link 26 will not be driven. A pair of jaws 29 are provided to grip the first formed tobacco member G at the end of an infeed chute 28 and to deliver the gripped member to the roller nest (not shown). With the control circuit closed by the switch portion 16 of the relay 14, current flows through the coil 21 of the solenoid 20 driving the plunger 22 thereof outwardly toward the infeed chute 28 preventing or blocking the first formed tobacco member G from assuming a position at the head of the chute where it can be gripped by the jaws 29. The jaws 29, although empty, move to the roller nest and open in the normal manner as the machine continues its uninterrupted operation.

The blast from the jet 10 is momentary or of limited duration and terminates before the carrier plate of the carrier C rotates into alignment with the paster. When the blast of pressure fluid terminates, the free end of the probe 11 returns to its normal position opening the sensing circuit and de-energizing or releasing relay 14. De-energizing the relay 14 normally would cause its contacts or switch portion 16 to open which would open the control circuit and de-energize solenoids 17 and 20. It is for this reason that the relay 14 is provided with a delay on release. The delay on release is of a duration to keep the contacts or switch portion 16 closed until the paster linkage has completed its operating cycle and the jaws 29 have completed its travel to pick-up a formed tobacco member and has started on its path to the roller nest.

Upon termination of the delay on release, the contacts or switch portion 16 of the relay 14 opens which opens or breaks the control circuit and de-energizes the solenoids 17 and 20 causing the plungers 19 and 22 thereof to reassume their normal retracted positions. Conventional spring means will move the end of the link 26 laterally so the pin 25 will again be disposed in the offset at the end of the slot 27. Accordingly, the paster and the means for transferring a formed tobacco member to the roller nest are in condition for normal operation during the next operating cycle of the machine.

The sensing and control circuit of FIG. 1 can be modified to respond to the vacuum or suction provided for retaining a tobacco strip on the carrier plate. Before describing the modified circuit, it should be understood that it is standard practice, as shown in U.S. Pat. No. 2,287,004 granted June 16, 1942 to H. H. Wheeler, to provide a carrier with valve means which cuts off the carrier plate from suction from the time a tobacco strip is removed at the roller nest until the plate arrives at a position to receive another tobacco strip Referring now to FIG. 2, the carrier C is connected to a vacuum or a source of suction by a conduit S. As the carrier C rotates to its transfer position, the valving therein will open the carrier plate to suction and the plate will receive a tobacco strip held by the suction. The carrier C continues to rotate, stopping momentarily at the paster on its way to deliver the tobacco strip on the carrier plate to the roller nest. At this time the valving gradually cuts suction off from the carrier plate as the tobacco strip is removed and wrapped on to the formed tobacco member being rolled. The valving remains closed as the carrier C continues to rotate to its transfer position. Thus, the negative fluid pressure in the conduit S remains substantially constant during the complete cycle of the carrier C under normal operating conditions.

In lieu of the probe 11 and relay 14 with delay on release of the sensing and control means of FIG. 1, a pressure responsive switch 31 and a relay 32 without a delay is provided. Under normal operating conditions, the constant negative pressure of suction in the conduit S keeps the switch 31 open. Therefore, as with relay 14, the relay 32 is not energized and its switch portion remains open. The solenoids 17 and 20, of course, remain de-energized.

If a tobacco strip is not transferred to the carrier C, air will be drawn through the carrier plate by the suction and the negative pressure will drop causing the actual pressure present in the conduit S to rise. This change in pressure will close the switch 31 thereby energizing the relay 32 whose contacts or switch portion then closes and completes the control circuit. With the control circuit complete, the solenoids 17 and 20 are energized and prevent operation of the paster and transfer of a formed tobacco member to the roller nest as previously described. Since the higher pressure in the conduit S will be present until the carrier plate arrives at the roller nest and the valving in the carrier C closes, the relay 32 does not require a delay on release.

When the valving in the carrier C closes, the negative pressure will rise causing the actual pressure in the conduit S to drop to its original level and open the switch 31. The opening of switch 31 de-energizes the relay 32 which breaks the control circuit and the solenoids 17 and 20 are again de-energized.

The novel sensing and control means may be made as a pressure fluid system as shown in FIG. 3. Conduit or tube means 33 is provided to connect the suction conduit S to a pair of bellows 34 and 36 corresponding to solenoids 17 and 20, respectively. The bellows 34 and 36 are provided with respective plunger means 35 and 37 which correspond to solenoid plungers 19 and 22, respectively. During normal operation, the constant negative pressure present in the conduit S keeps the bellows 34 and 36 in their collapsed positions. When a tobacco strip has not been transferred to the carrier C, the pressure then present in the conduit S permits the bellows 34 and 36 to expand moving their respective plunger members 35 and 37 to interrupt paster operation and the transfer of a formed tobacco member to the roller nest.

Although several embodiments of the invention have been illustrated and described in detail, it is to be expressly understood that the invention is not limited thereto. Various changes in the design and arrangement of parts may be made without departing from the spirit and scope of the invention as the same will now be understood by those skilled in the art.

I claim:

1. In a cigar machine having a roller nest, a rotatable carrier for delivering a tobacco strip to the roller nest, a paster and means for delivering formed tobacco members to the roller nest, a control for preventing particular operations of the machine while permitting the machine to continue to run, comprising a source of pressure fluid, first means operatively associated with said carrier and responsive to fluid pressure from said source for detecting the absence of a tobacco strip from the carrier immediately prior to the operation of the paster and second means for preventing operation of the paster and for preventing the delivery means from delivering a formed tobacco member to the roller nest only when the absence of a tobacco strip from the carrier has been detected by said first means.

2. A control in accordance with claim 1 and said first means comprising a normally open electrical sensing circuit having a switch means closing said circuit in response to the fluid pressure in the absence of a tobacco strip from said carrier and a relay means with a normally open switch portion which closes when said relay means is energized by said sensing circuit when said sensing circuit is closed, said second means comprising a normally open electrical control circuit having means for operatively uncoupling the paster from its operating linkage and for preventing the delivery means from receiving a formed tobacco member only when said control circuit is closed, and said control circuit being connected to the switch portion of said relay means and opened and closed thereby.

3. A control in accordance with claim 2, and the carrier and a spring contact arm having a free end spaced from the carrier providing said switch means of said sensing circuit, a tube having its discharge end spaced from said free end of said arm on the opposite side thereof from said carrier providing a blast of fluid pressure urging said free end of said arm towards said carrier, and said blast of fluid pressure being timed so said free end of said arm contacts and is insulated from said carrier by a tobacco on said carrier approaching the paster and contacting the carrier thereby closing said sensing circuit in the absence of a tobacco strip from the carrier.

4. A control in accordance with claim 3, wherein said blast of fluid pressure is momentary, and said relay means including means for holding the switch portion closed for a predetermined period of time after said relay means is de-energized.

5. A control in accordance with claim 2, and the carrier being connected to a controlled source of suction valved to hold a tobacco strip on the carrier and cause said carrier to deliver the tobacco strip to the roller nest, said sensing circuit including a pressure switch responsive to negative fluid pressure of the suction when a tobacco strip is held on the carrier for maintaining said sensing circuit open and closing said sensing circuit in response to the lower negative fluid pressure in the absence of a tobacco strip from the carrier.

6. A control in accordance with claim 1, and said source of pressure fluid being suction connected to the carrier and valved to hold a tobacco strip on the carrier from a point of pick-up of the tobacco strip to the roller nest, said first means comprising conduit means connected to said suction, and said second means being expansible means retained in a contracted condition by the negative fluid pressure of said suction when a tobacco strip is held on the carrier and expanding to prevent paster operation and delivery of a formed tobacco member in response to lower negative pressure fluid in the absence of a tobacco strip from the carrier.

* * * * *